US007735967B2

(12) United States Patent
Takenaka et al.

(10) Patent No.: US 7,735,967 B2
(45) Date of Patent: Jun. 15, 2010

(54) ACTUATOR FOR MANIPULATION OF LIQUID DROPLETS

(75) Inventors: Kei Takenaka, Kashiwa (JP); Yasushi Goto, Kokubunji (JP)

(73) Assignee: Hitachi, Ltd., Tokyo (JP)

( * ) Notice: Subject to any disclaimer, the term of this patent is extended or adjusted under 35 U.S.C. 154(b) by 651 days.

(21) Appl. No.: 11/737,791

(22) Filed: Apr. 20, 2007

(65) Prior Publication Data

US 2008/0018709 A1 Jan. 24, 2008

(30) Foreign Application Priority Data

Jul. 4, 2006 (JP) ..... 2006-183979

(51) Int. Cl.
*B41J 2/04* (2006.01)

(52) U.S. Cl. ..... 347/54; 347/58; 204/450; 204/600

(58) Field of Classification Search ..... 347/20, 347/54, 56–59

See application file for complete search history.

(56) References Cited

U.S. PATENT DOCUMENTS 7,531,072 B2 * 5/2009 Roux et al. ..... 204/450
2004/0058450 A1 3/2004 Pamula et al.

FOREIGN PATENT DOCUMENTS

JP 10-267801 10/1998

OTHER PUBLICATIONS

Michael G. Pollack et al.; Electrowetting-based actuation of liquid droplets for microfluidic applications; Applied physics Letters; Sep. 11, 2000, pp. 1725-1726; vol. 77, No. 11.
Hyejin Moon et al.; Low voltage electrowetting-on-dielectric; Journal of Applied Physics; Oct. 1, 2002; pp. 4080-4087; vol. 92, No. 7.
Shih-Kang Fan et al.; Manipulation of Multiple Droplets on NxM Grid by Cross-Reference EWOD Driving Scheme and Pressure-Contact Packaging; IEEE; 2003; pp. 694-697.
Masao Washizu; Electrostatic Actuation of Liquid Droplets for Micro-Reactor Applications; IEEE Industry Applications Society Annual Meeting; New Orleans, Louisiana, Oct. 5-9, 1997; pp. 1867-18730.

* cited by examiner

*Primary Examiner*—Juanita D Stephens
(74) *Attorney, Agent, or Firm*—Antonelli, Terry, Stout & Kraus, LLP.

(57) ABSTRACT

A liquid conveying substrate comprises: rectangular electrodes which are disposed on the substrate surface and whose surfaces are covered with a dielectric with a water repellent surface; first axial electrode columns where the rectangular electrodes are coupled in an x direction; and second axial electrode columns where the rectangular electrodes are coupled in a y direction. Accordingly, electrodes necessary for conveying liquid droplets can be arranged on one substrate, and the number of mechanisms for controlling the potential can be suppressed.

14 Claims, 16 Drawing Sheets

ACTUATOR FOR MANIPULATION OF LIQUID DROPLETS

CROSS-REFERENCE TO RELATED APPLICATION

The present application claims priority from Japanese Patent Application No. JP 2006-183979 filed on Jul. 4, 2006, the content of which is hereby incorporated by reference into this application.

TECHNICAL FIELD OF THE INVENTION

The present invention relates to an actuator for manipulation of liquid droplets for manipulating droplets by making use of electrostatic force.

BACKGROUND OF THE INVENTION

Recently, in the background of mounting concern about environmental problems and social demand for advanced medical care, there is an increasing request for technology and apparatus capable of analyzing traces of chemical substance or biological substance easily. Owing to the advantages in cost, ease of handling and shortening of measuring time, as compared with the conventional analytical technology, intensive studies are actively conducted in the field of micro total analysis system (also referred to as μTAS or Lab-On-Chip).

In the micro total analysis system, a series of chemical operations such as sample mixing, reaction and separation are "micronized" and integrated on a glass or plastic substrate. Previously, studies of the micro total analysis system are mainly about handling of sample liquid as continuous fluid, but recently, the studies for handling liquid as droplets have attracted attention because pump and valve are not required and power consumption is smaller (US 2004/0058450 (Patent Document 1), Japanese Patent Application Laid-Open Publication No. 10-267801 (Patent Document 2), Applied Physics Letters, Vol. 77, No. 11, pp. 1725-1726 (Non-Patent Document 1), Journal of Applied Physics, Vol. 92, No. 7, pp. 4080-4087 (Non-Patent Document 2), Proc. MEMS2003, pp. 694-697 (Non-Patent Document 3), and IEEE Industry Applications Society, Annual meeting, New Orleans, La., Oct. 5-9, 1997, "Electrical actuation of liquid droplet for microreactor applications" (Non-Patent Document 4)).

One of the methods for handling liquid as droplet is known as Electrowetting. Electrowetting is a technology for controlling the wetting of liquid on the solid surface by the application of voltage, and the principle of conveying droplets is described as Electrocapillarity or Electromoistening in Non-Patent Documents 1 and 2 and Patent Document 1.

M. G. Pollack et al. have invented a device in Non-Patent Document 1, in which a lower substrate having a plurality of electrodes for control on its flat surface and an upper substrate having a ground electrode on its flat surface are disposed in parallel with interposing a gap therebetween, the gap is filled with silicone oil, and droplets of electrolyte are put therein. The Non-Patent Document 1 has reported that, by changing over the switches coupled to the plurality of electrodes for control, potentials of the electrodes for control are controlled, and the droplets of electrolyte existing in the gap between the substrates filled with silicone oil are conveyed with the applied voltage of 40 V to 80 V. At this time, the plurality of electrodes for control on the lower substrate are covered with a dielectric layer (parylene, thickness: 700 nm), and the surface thereof is covered with water repellent substance (Teflon (registered trademark), thickness: 200 nm). Further, the ground electrode on the upper substrate is also covered with water repellent substance (Teflon (registered trademark), thickness: 200 nm). Also, M. G. Pollack et al. have described a device having ground electrode and control electrode on the same substrate and a conveying mechanism on one side in Patent Document 1.

As an example where liquid droplets are conveyed in the air without using the silicone oil as the filler in the same structure as in Non-Patent Document 1, a device by H. Moon et al. is known. In Non-Patent Document 2, H. Moon et al. have reported that droplets can be conveyed with the applied voltage of 15 V, by making use of a high dielectric material such as BST (Barium Strontium Titanate) as the dielectric.

The devices by M. G. Pollack et al. and H. Moon et al. are devices for moving the droplets in a one-dimensional direction. However, in Non-Patent Document 3, S.-K. Fan et al. have reported the development of EWOD (Electro Wetting On Dielectric) liquid delivery device, in which a lower substrate having N rectangular electrodes and an upper substrate having M rectangular electrodes are combined so that the corresponding electrodes are arranged at a right angle, and the droplets are moved to the positions of N×M lattice points composed of the upper and lower electrodes.

As another method in which liquid is handled as droplets, the method, in which the Maxwell stress distribution on the droplet surface is changed by switching the potentials of electrodes present below the droplets, thereby conveying the droplets, is known.

In Non-Patent Document 4, by using a device having a plurality of electrodes on its flat surface and sequentially switching the potentials of the electrodes, Washizu has successfully conveyed droplets present on the device in a one-dimensional direction with the applied voltage of 400 Vrms. At this time, the plurality of electrodes on the substrate are covered with a dielectric layer (SC450 (registered trademark), thickness: 10 μm), and the surface thereof is covered with water repellent substance (Teflon (registered trademark)). Further, in Patent Document 2, Washizu has described a structure in which a pipe with a water repellent surface is provided on a device having a plurality of electrodes on its flat surface.

SUMMARY OF THE INVENTION

When the device using the method mentioned above is applied to a chemical analysis apparatus and others, it is important to realize and measure various chemical reactions in accordance with the purpose and application of the user in the device. In other words, important matters include versatility for conveying a desired amount of liquid freely in two-dimensional directions, accuracy for precisely conveying the liquid to a desired position, and flexibility for enabling the mixed mounting with a sensor, a reactor and others. The following problems may be considered in the method for handling liquid as droplets by electrical control.

The devices in Patent Documents 1 and 2 and Non-Patent Documents 1, 2 and 4 have a structure where electrodes are individually disposed at each position for conveying the liquid. Therefore, as the number of conveying positions increase, the number of electrodes increases, and the number of wirings and switches for controlling the potential of each electrode also increases. The increase in the number of wirings and switches increases the load on the system devices, and it is hence desired to convey the liquid droplets with a smaller number of wirings and switches.

In the device in Non-Patent Document 3, liquid droplets can be freely conveyed to positions of N×M lattice points composed of upper and lower electrodes by the N+M electrodes and corresponding switches. However, since electrodes necessary for driving have to be disposed on both upper and lower substrates, it is difficult to mount the sensor and reactor together on the substrate.

On the other hand, in Non-Patent Document 4, since a plurality of electrodes necessary for driving are disposed on one plane, the sensor and reactor can be mounted on the other substrate, but nothing has been considered about quantitativeness for conveying a specified volume of liquid or accuracy for conveying or stopping the liquid precisely at a specified position. As described above, at present, a device enabling the mixed mounting with a sensor and a reactor and achieving the accurate positioning has not been realized yet.

For the solution of the problems described above, the inventors of the present invention have studied about the formation of electrodes for conveying liquid droplets on one plane. FIG. 1 is a model diagram of a part of a liquid conveying substrate 23 in which a plurality of rectangular electrodes 231 are coupled in side directions, and it shows relative positions of the plurality of rectangular electrodes 231 on a surface of the substrate. FIG. 2A and FIG. 2B are diagrams showing first axial electrode columns 2315 to 2320 where the rectangular electrodes 231 are coupled in an x-axis direction and second axial electrode columns 2335 to 2340 where the rectangular electrodes 231 are coupled in a y-axis direction on the liquid conveying substrate 23 where the plurality of rectangular electrodes 231 are coupled in side directions, and the potentials of the plurality of rectangular electrodes 231 when potential difference is applied between a pair of the first axial electrode column and the second axial electrode column.

In FIG. 1, the liquid conveying substrate 23 has a plurality of rectangular electrodes 231 laid on the substrate surface, and the plurality of rectangular electrodes 231 are coupled in a direction of either one side of the rectangular electrodes 231, that is, in an x direction or a y direction in the diagram. All conductors coupling the rectangular electrodes 231 in the x direction are referred to as first axial coupling conductors 232, and all conductors coupling them in the y direction are referred to as second axial coupling conductors 233. The rectangular electrodes 231 coupled in the x direction by the first axial coupling conductors 232 are regarded as one electrode column in each row and are called first axial electrode columns 2311 to 2314. Also, the rectangular electrodes 231 coupled in the y direction by the second axial coupling conductors 233 are regarded as one electrode column in each row and are called second axial electrode columns 2331 to 2334 from the left side of the diagram. The first axial coupling conductors 232 are disposed to be positioned in the lower layer of the rectangular electrodes 231 constituting the second axial electrode columns, and the second axial coupling conductors 233 are disposed to be positioned in the lower layer of the rectangular electrodes 231 constituting the first axial electrode columns. The first axial coupling conductors 232 and the rectangular electrodes 231 constituting the second axial electrode columns and the second axial coupling conductors 233 and the rectangular electrodes 231 constituting the first axial electrode columns are electrically insulated by way of an insulating layer, respectively.

In FIG. 2, when a potential difference is applied to the first axial electrode column 2317 and the second axial electrode column 2337 on the liquid conveying substrate 23, a range 241 where two electrodes are crossed forms a rectangle composed of three rectangular electrodes arranged vertically, and an electric field with large gradient in the vertical direction is generated. Also, when a potential difference is applied to the second axial electrode column 2338 which is the second axial electrode column adjacent to the second axial electrode column 2337 and the first axial electrode column 2317, a range 242 where two electrodes are crossed forms a rectangle composed of three rectangular electrodes arranged laterally, and an electric field with large gradient in the lateral direction is generated. More specifically, in the liquid conveying substrate 23 where the rectangular electrodes 231 are coupled in the side directions, the change in the shape of liquid droplets depending on the gradient of electric field is enlarged in accordance with the combination of the first axial electrode column and the second axial electrode column to which the potential difference is applied.

An object of the present invention is to provide a device capable of mixed mounting with a sensor and a reactor, stably conveying liquid droplets, and achieving accurate positioning of the droplets, even if the number of wirings and switches is reduced.

An embodiment of a liquid conveying substrate of the present invention comprises: a substrate; a plurality of first electrodes disposed on the substrate and arranged in a plurality of columns in a first axial direction; a plurality of first conductors respectively connecting two adjacent first electrodes of the plurality of first electrodes and arranged along the first axial direction; a plurality of second electrodes disposed on the substrate and arranged in a plurality of columns in a second axial direction crossing with the first axial direction; a plurality of second conductors respectively connecting two adjacent second electrodes of the plurality of second electrodes, arranged along the second axial direction, and crossing with the first conductors; and an insulating layer for insulating the first conductors and the second conductors, wherein the first conductor and the second conductor cross with each other in a region where the first electrodes and the second electrodes are not positioned as seen from the side where the first electrodes are substantially disposed, and the insulating layer is positioned at least in the crossing region.

Further, the second electrodes may be disposed within a lattice composed of centers of gravity of four first electrodes arranged adjacently in two continuous columns in the first axial direction.

Further, the first electrodes and the second electrodes and the first conductors and the second conductors may be covered with a dielectric layer having a water repellent surface.

The shape of the first electrodes and the second electrodes is polygonal, preferably, even-numbered polygonal, more preferably, square. When the shape of the first electrodes and the second electrodes is square, a first vertex and a second vertex opposite to the first vertex are disposed in the first axial direction, and a third vertex and a fourth vertex opposite to the third vertex are disposed in the second axial direction. A most typical example is a checkered pattern.

Also, when the liquid droplet conveying efficiency is taken into account, the electrostatic capacity of liquid droplet and electrode is required to be sufficiently larger than the electrostatic capacity of an element. So, the first electrode and the second electrode are designed to have an area of 1 $\mu m^2$ or more to 1 $mm^2$ or less.

Further, in the liquid conveying method of the present invention, a first electrode control device for changing the potential of the plurality of first electrodes and a second electrode control device for changing the potential of the plurality of second electrodes may be provided, and a potential difference is applied to at least one pair of the first electrode and the second electrode by the first electrode control means and the second electrode control means. At this time, the potential of at least one pair of the first electrode and the second electrode to which the potential difference is applied may be changed after a specified time.

Further, another flat substrate may be disposed substantially opposite and parallel to the substrate having the first electrodes and the second electrodes, and the interval between the substrate having the first electrodes and the second electrodes and the flat substrate may be designed to be 100 nm or more to 1 mm or less.

Further, a substrate having temperature regulator, sensor and reactor may be disposed substantially in parallel, and a system device for analyzing outputs from the temperature regulator and sensor and outputting a signal for conveying the intended liquid droplet, a first electrode control device for changing the potential of the plurality of first electrodes by a signal from the system device, and a second electrode control device for controlling the potential of the plurality of second electrodes by the signal from the system device may be provided.

According to the present invention, electrodes covered with a dielectric are arranged two-dimensionally on a substrate surface, and a potential difference is applied to at least one pair of electrodes in a first axial direction and electrodes in a second axial direction among the electrode groups coupled in the first axial direction or the second axial direction, thereby conveying or stopping the liquid droplet. Since the device of the present invention does not require the switch for controlling the potential for each position for conveying the liquid, the number of switches required in the operation can be reduced, and the load on the system for controlling the operation can be decreased. Even if passage grooves are not formed on the device surface, the liquid droplet on the device can be conveyed in a route suited to the purpose of the user. Further, by switching the potential to be applied, deviation of the position of the conveyed liquid droplet can be corrected. Also, since it is not necessary to use a substrate having electrodes required to convey the liquid droplet in the upper part of the device, a substrate having a temperature regulator, sensor or reactor can be easily used. At this time, since the order and the time of contacting with the temperature regulator, sensor or reactor can be changed by controlling the conveying route of the liquid droplet, a chemical analysis apparatus suited to various purposes can be realized.

BRIEF DESCRIPTIONS OF THE DRAWINGS

DESCRIPTIONS OF THE PREFERRED EMBODIMENTS

Hereinafter, embodiments of the present invention will be described in detail with reference to the accompanying drawings.

First Embodiment

Figure 1:
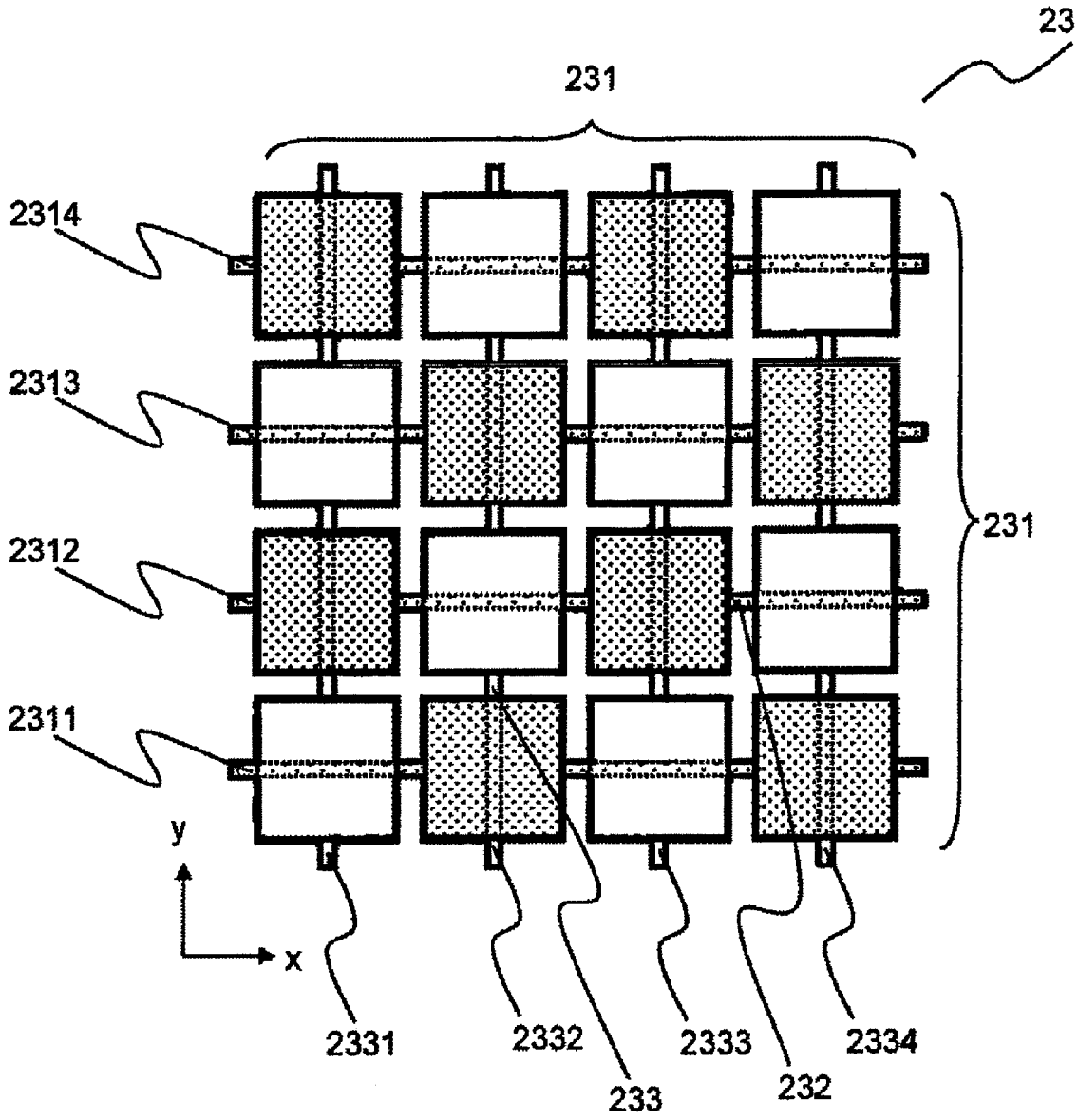
FIG. 1 is a model diagram of a liquid conveying substrate where rectangular electrodes are coupled in a side direction.
Figure 2A:
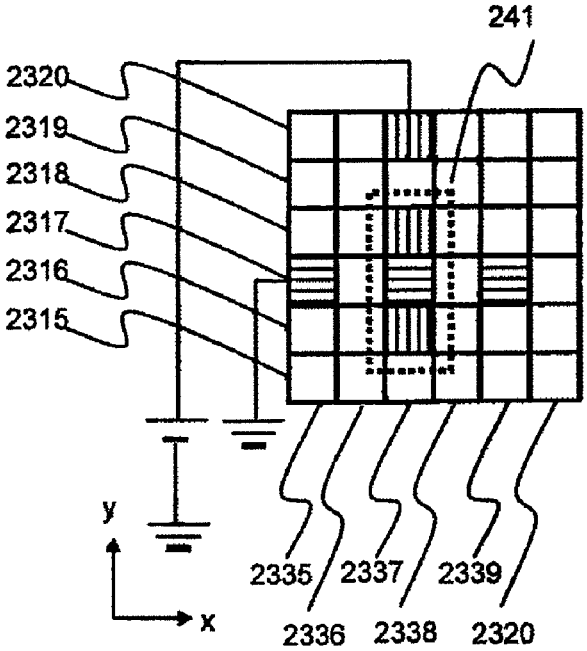
FIG. 2A is an explanatory diagram of operation state of a liquid conveying substrate where rectangular electrodes are coupled in a side direction.
Figure 2B:
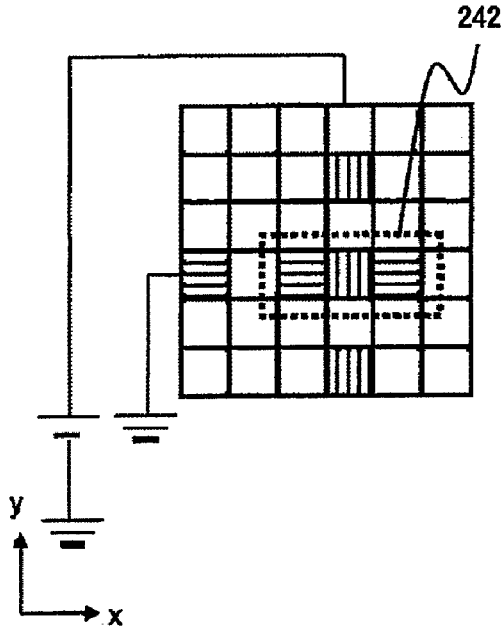
FIG. 2B is an explanatory diagram of operation state of a liquid conveying substrate where rectangular electrodes are coupled in a side direction.
Figure 3:
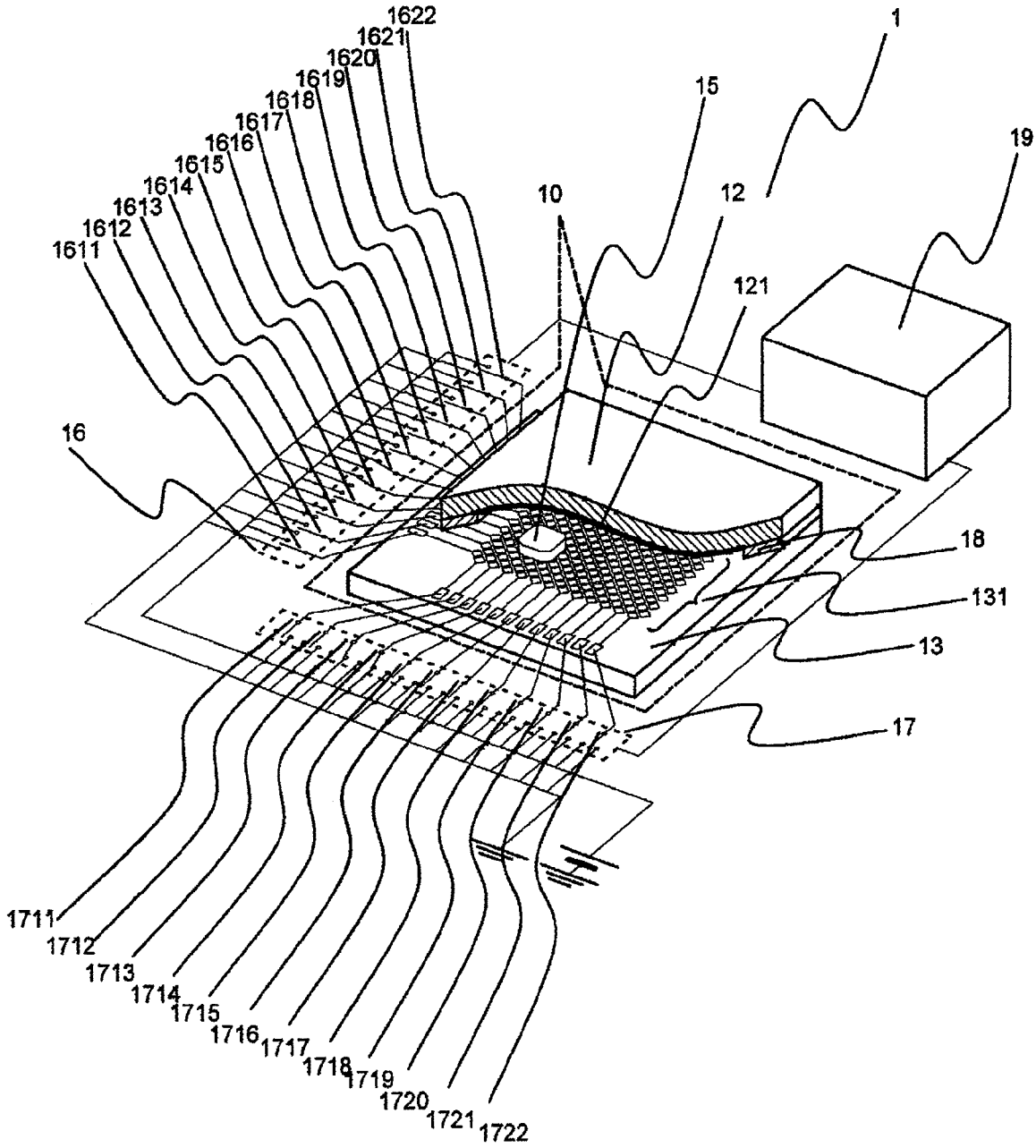
FIG. 3 is a block diagram showing an example of an actuator for manipulation of liquid droplets.

FIG. 3 is a diagram showing a structural example of an actuator for manipulation of liquid droplets of this embodiment. The actuator for manipulation of liquid droplets 1 of this embodiment is composed of a liquid conveying element 10 for holding a liquid droplet 15, a first axial voltage control device 16 and a second axial voltage control device 17 for controlling the voltage to be applied to the liquid conveying element 10, and a system device 19 for outputting control signals to the first axial voltage control device 16 and the second axial voltage control device 17.

The liquid conveying element 10 is configured by arranging an upper substrate 12 and a liquid conveying substrate 13 having a plurality of rectangular electrodes 131 for driving so as to form a gap therebetween by means of a spacer 18, and the liquid droplet 15 to be conveyed is held in the gap between the two substrates. It is desired that the upper substrate 12 and the liquid conveying substrate 13 are substantially disposed in parallel to each other. The diagram is a bird's-eye view of the liquid conveying element 10 illustrating a part of the spacer 18 and the upper substrate 12 in a sectional view.

For the spacer 18, a double-sided tape for electronic appliance of 10 μm to 1000 μm in thickness, for example, a double-sided tape using a polyester film base and an acrylic adhesive is used. For the further reduction of the thickness, a spacer formed of a photosensitive material such as photoresist may be used. Alternatively, a difference in level may be provided in the upper substrate 12 or the liquid conveying substrate 13 through the semiconductor manufacturing process using Deep RIE (Deep Reactive Ion Etching) or the like.

For the upper substrate 12, a glass plate having an upper substrate water repellent layer 121 on the water droplet 15 side is used. As other material used for the upper substrate 12, a substance with high flatness is preferable, and if transparency is necessary for the observation of movement of the liquid droplet 15, quartz, PMMA (polymethacrylic methyl (polymethylmethacrylate, acrylic resin)), and others may be used. The upper substrate water repellent layer 121 is made of fluorine resin, and water repellent materials other than fluorine resin include silicone resin. The water repellency mentioned here means water contact angle of 90° or more. In this embodiment, in order to describe the conveyance of liquid, a reactor and a sensor are not formed on the upper substrate 12. However, the same conveyance is possible even when the upper substrate on which the reactor and the sensor are disposed is used. The liquid conveying substrate 13 will be described later.

According to a signal outputted from the system device 19, the first axial voltage control device 16 and the second axial voltage control device 17 change over first axial liquid conveying switches 1611 to 1622 and second axial liquid conveying switches 1711 to 1722, and the electric state of the rectangular electrode group 131 is controlled to one of the ground, potential given from power source, and floating, thereby conveying the liquid droplet 15.

Figure 4:
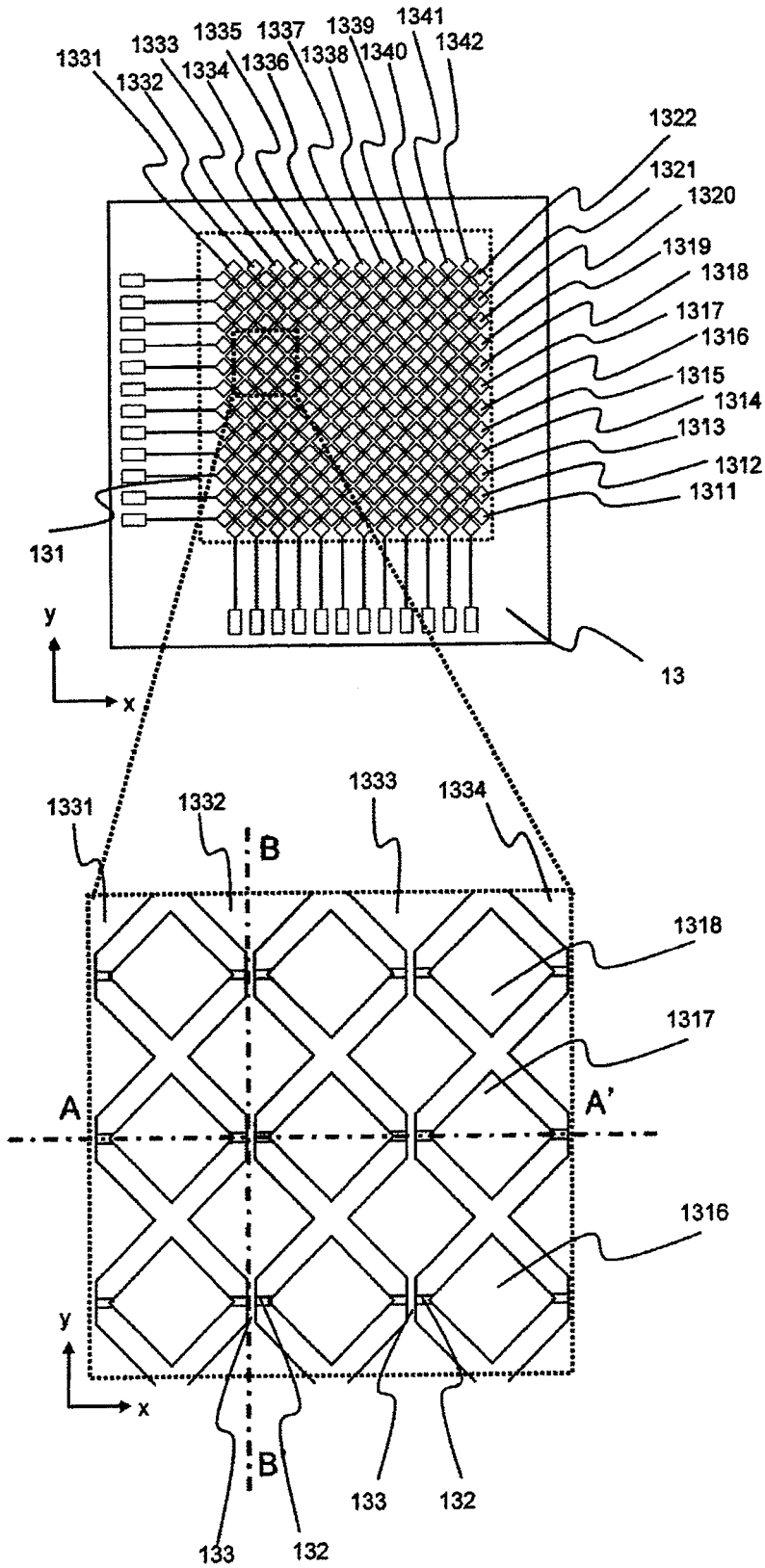
FIG. 4 is a plan view of a liquid conveying substrate.

FIG. 4 includes a plan view of the entire structure of the liquid conveying substrate 13 and a partially enlarged view of the liquid conveying substrate 13, showing the structure of the liquid conveying substrate 13 constituting the liquid conveying element 10. A relative configuration of a plurality of rectangular electrodes 131 on the substrate surface is illustrated therein. The liquid conveying substrate 13 has a plurality of rectangular electrodes 131 laid on the substrate surface, and the plurality of rectangular electrodes 131 are coupled in a direction of any one diagonal line of the rectangular electrodes 131, that is, in either x direction or y direction in the diagram. The electrodes are rectangular here, but they may also be polygonal or even-numbered polygonal in particular. In the case of a square shape, a first vertex and a second vertex opposite to the first vertex are disposed in the first axial direction, and a third vertex and a fourth vertex opposite to the third vertex are disposed in the second axial direction. All conductors coupling the rectangular electrodes 131 in the x direction are referred to as first axial coupling conductors 132, and all conductors coupling them in the y direction are referred to as second axial coupling conductors 133. The rectangular electrodes 131 coupled in the x direction by the first axial coupling conductors 132 are regarded as one electrode column in each row and are called first axial electrode columns 1311 to 1322 from the bottom of the diagram. Also, the rectangular electrodes 131 coupled in the y direction by the second axial coupling conductors 133 are regarded as one electrode column in each row and are called second axial electrode columns 1331 to 1342 from the left side of the diagram. The first axial coupling conductors 132 and the second axial coupling conductors 133 have a hierarchical structure with interposing an insulating layer therebetween in a region among the rectangular electrodes 131. In this structure, the region where the electrodes are overlapped as seen from the top of the substrate is eliminated, and the region where the first axial coupling conductor and the second axial coupling conductor are overlapped is minimized. Accordingly, the power consumption due to a capacitor effect between the x-direction electrode column and the y-direction electrode column can be avoided. In this embodiment, the first axial coupling conductors 132 are disposed to be positioned in the lower layer of the second axial coupling conductors 133. The first axial coupling conductors and the second axial coupling conductors cross with each other in a region where the electrode group coupled in the x direction and the second electrode group coupled in the y direction are not positioned as seen from the side where the plurality of electrodes are substantially disposed. The insulating film is disposed so as to be positioned at least between the first axial coupling conductor and the second axial coupling conductor in the crossing region.

Figure 5:
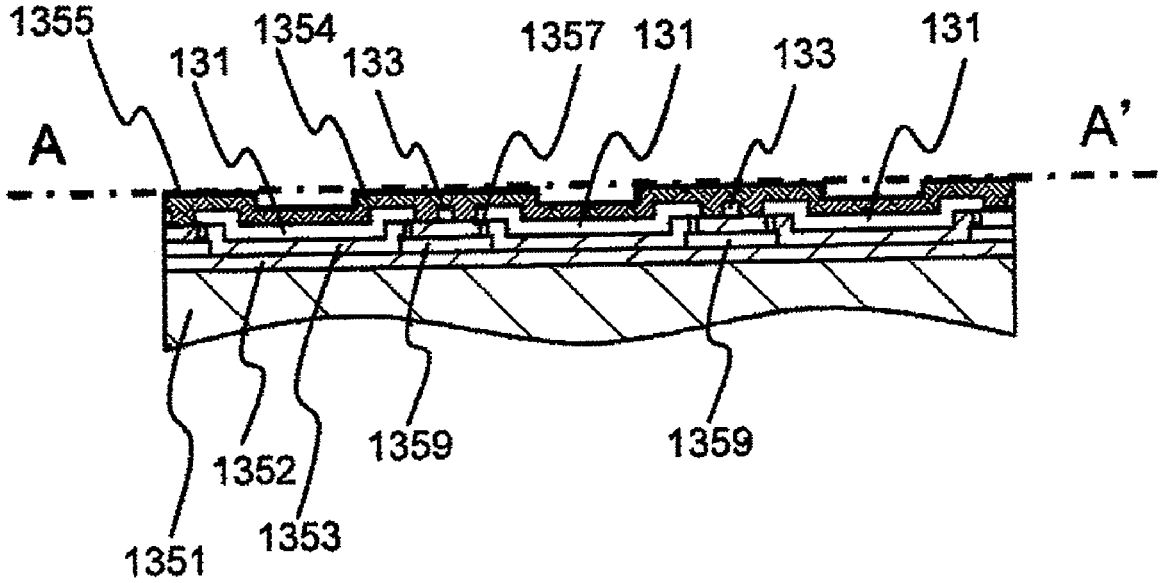
FIG. 5 is a sectional view of a liquid conveying substrate.
Figure 5:
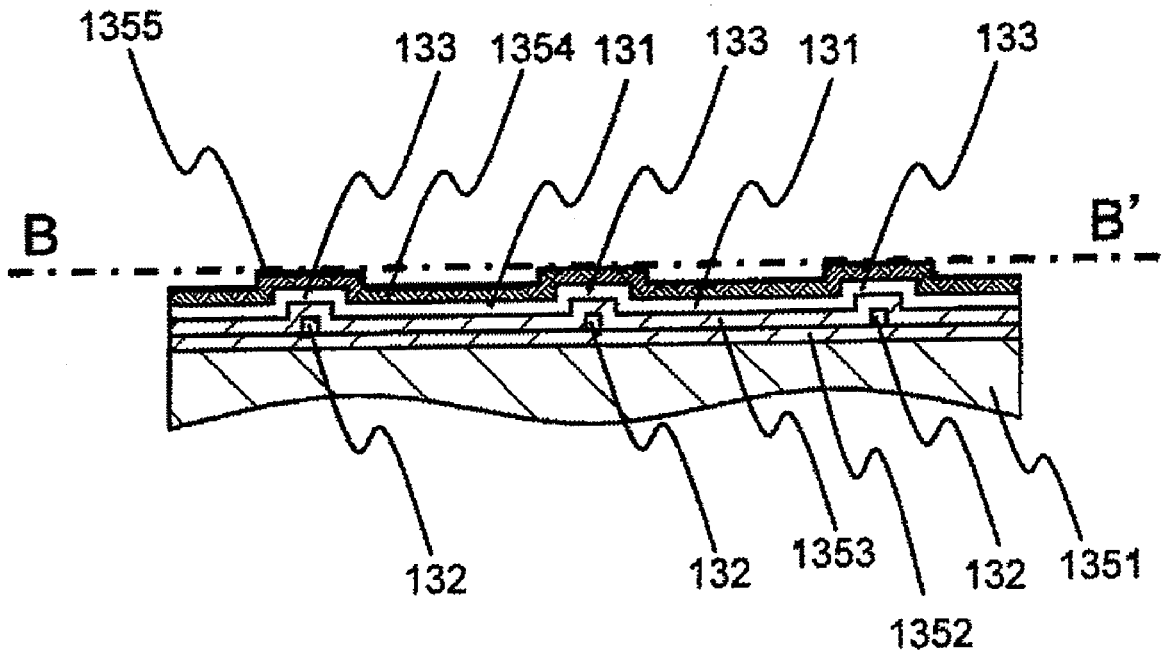

FIG. 5 includes a sectional view of the lower substrate 13 taken along the line A-A' in FIG. 4 and a sectional view thereof taken along the line B-B' in FIG. 4. Particularly, the structure of the first axial coupling conductors 132 and the second axial coupling conductors 133 in the crossing region is shown. The first axial coupling conductor 132 is composed of a lower layer conductor 1359 and a plug 1357. The liquid conveying substrate 13 is composed of, from the lower side, a base substrate 1351, a bottom insulating layer 1352, an insulating layer between electrode columns 1353, a lower layer conductor 1359, a plug 1357, a second axial coupling conductor 133, a rectangular electrode 131, a dielectric layer 1354, and a water repellent layer 1355 on a liquid conveying substrate. In the crossing region of the first axial coupling conductor 132 and the second axial coupling conductor 133, the insulating layer between electrode columns 1353 is present between the first axial coupling conductor 132 and the second axial coupling conductor 133. Therefore, the two electrode columns are electrically insulated.

Silicon is used as the material of the base substrate 1351, silicon oxide is used for the bottom insulating layer 1352 and the insulating layer between electrode columns 1353, tungsten is used for the rectangular electrode 131, the first axial coupling conductor 132, and the second axial coupling conductor 133, silicon nitride of 75 nm is used for the dielectric layer 1354, and fluoropolymer resin is used for the water repellent layer 1355 on the liquid conveying substrate. If transparency is necessary for the observation of movement of the liquid droplet 15, as other material used for the base substrate 1351, glass and quartz may be used. As other materials for the bottom insulating layer 1352 and the insulating layer between electrode columns 1353, highly insulating materials such as silicon nitride may be used. When insulator such as glass or quartz is used for the base substrate 1351, the bottom insulating layer 1352 is not always necessary. As other materials for the rectangular electrode 131, the first axial coupling conductor 132, and the second axial coupling conductor 133, aluminum, gold, platinum and other metal materials may be used, and ITO (indium tin oxide) is preferred if transparency is important. As other materials for the dielectric layer 1354, high dielectric materials are preferable, for example, metal oxides and metal nitrides such as silicon oxide, alumina, tantalum oxide, BST (Barium Strontium Titanate), zirconium oxide, hafnium oxide, alumina, titanium oxide, and lanthanum oxide, and insulators by combining these materials such as hafnium aluminate (HfAlO) may be used. As other materials for the water repellent layer 1355 on the liquid conveying substrate, silicone resin may be used. The water repellency mentioned here means water contact angle of 90° or more.

Figure 6:
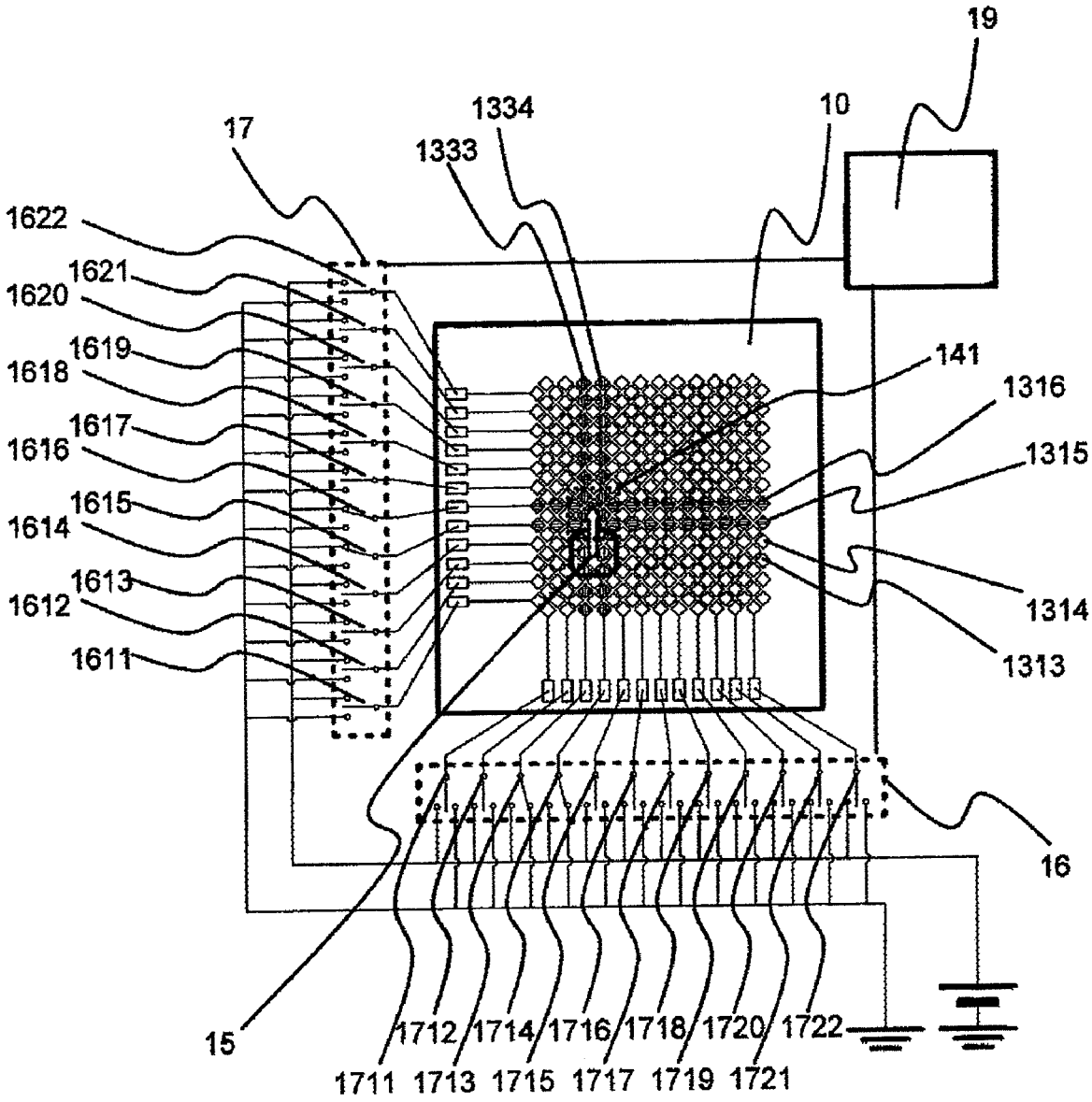
FIG. 6 is an explanatory diagram of the operation when liquid is conveyed by the actuator for manipulation of liquid droplets.

FIG. 6 is an explanatory diagram of the operation of the actuator for manipulation of liquid droplets 1 at the time of conveying the liquid droplet 15. The process of conveying the liquid droplet 15 to a destination position 141 will be described with reference to FIG. 6. The operation of the first axial liquid conveying switches 1611 to 1622 and the second axial liquid conveying switches 1711 to 1722 is controlled by the first axial voltage control device 16 and the second axial voltage control device 17 according to the signals outputted from the system device 19.

Before starting the conveyance of the liquid droplet 15, the first axial electrode columns 1311 to 1322 and the second axial electrode columns 1331 to 1342 are in a floating state, or the first axial electrode columns 1313 and 1314 are at a set potential $V_1$, the second axial electrode columns 1333 and 1334 are at a set potential $V_2$, and other electrode columns are in a floating state (provided $V_1>V_2$) for the purpose of stopping the liquid droplet 15. At this time, a part of the liquid droplet 15 is in contact with the first axial electrode column 1315 and the second axial electrode columns 1334 and 1335 via the dielectric layer 1354.

Next, the first axial liquid conveying switches 1615 and 1616 and the second axial liquid conveying switches 1713 and 1714 are changed over so that the potential of the first axial electrode columns 1315 and 1316 passing through the destination position 141 may be at the set potential $V_1$ and the potential of the second axial electrode columns 1333 and 1334 passing through the destination position 141 may be at the set potential $V_2$. For example, when silicon nitride of 100 nm in thickness is used for the dielectric layer, the set potentials are $V_1=15$ and $V_2=-15$. At the destination position 141, the first axial electrode columns 1315 and 1316 and the second axial electrode columns 1333 and 1334 cross with each other. A potential difference occurs via the liquid droplet 15 between these electrode columns, and the apparent wettability of the surface is increased by electrowetting. Therefore, the liquid droplet 15 moves to the destination position 141. In the diagram, the first axial electrode columns 1315 and 1316 in the state of potential $V_1$ are hatched by vertical lines, and the second axial electrode columns 1333 and 1334 in the state of potential $V_2$ are hatched by lateral lines so as to be distinguished from the other electrode columns. At this time, even if the first axial electrode columns 1315 and 1316 are in the state of the potential $V_2$ and the second axial electrode columns 1333 and 1334 are in the state of the potential $V_1$, the liquid droplet 15 moves to the destination position 141. In other words, the nearby liquid droplet 15 moves to the region adjacent to the first axial electrode column set at the potential $V_1$ (or $V_2$) and the second axial electrode column set at the potential $V_2$ (or $V_1$).

When two adjacent first axial electrode columns and two adjacent second axial electrode columns are selected from the first axial electrode columns 1311 to 1322 of 12 rows and the second axial electrode rows 1331 to 1342 of 12 columns, respectively, the number of combinations of the selected columns is 121. In other words, by combining the twelve first axial liquid conveying switches 1611 to 1622 and the twelve second axial liquid conveying switches 1711 to 1722, the liquid droplet can be conveyed to 121 different positions on the liquid conveying substrate 13.

Also, by varying the number of the first axial electrode columns and the second axial electrode columns to which the potential difference is applied, the effective area of the crossing region of the first axial electrode columns and the second axial electrode columns to which the potential difference is applied can be changed. With respect to the relation between the liquid droplet and the area of the region, the effective area of the region is designed to be slightly smaller than the contact area of the liquid droplet to be conveyed and the liquid droplet conveying substrate 13. Since the amount of liquid droplet 15 is equal to the product of contact area of the liquid droplet and the liquid conveying substrate 13 and the interval between the upper substrate 12 (FIG. 3) and the liquid conveying substrate 13, by varying the number of the first axial electrode columns and the second axial electrode columns to which the potential difference is applied, the liquid droplet 15 can be conveyed regardless of the amount thereof.

Further, since the liquid conveying element 10 includes all electrodes necessary for the conveyance of the liquid on the liquid conveying substrate 13, it can also be used as an open-type liquid conveying element without using the upper substrate 12 and the spacer 18.

In addition to the method described above, by appropriately changing the method of applying the voltage, the liquid droplet conveying capacity can be enhanced.

Figure 7A:
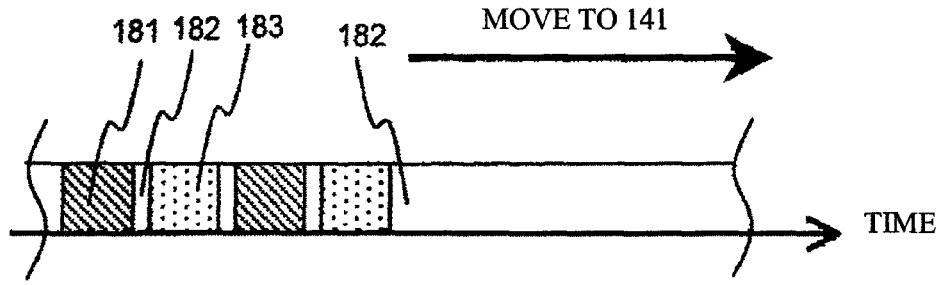
FIG. 7A is a time chart showing an application method of voltage by the actuator for manipulation of liquid droplets.
Figure 7B:
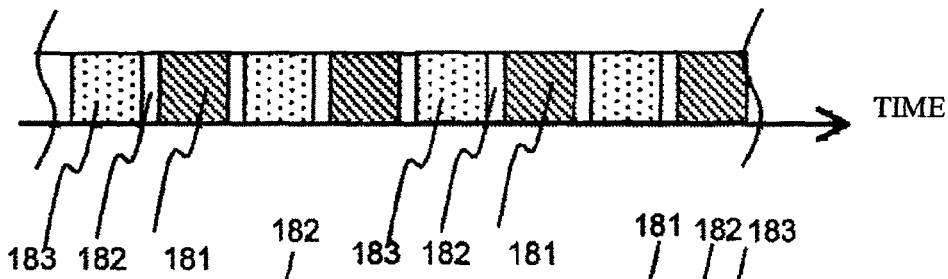
FIG. 7B is a time chart showing an application method of voltage by the actuator for manipulation of liquid droplets.
Figure 7C:
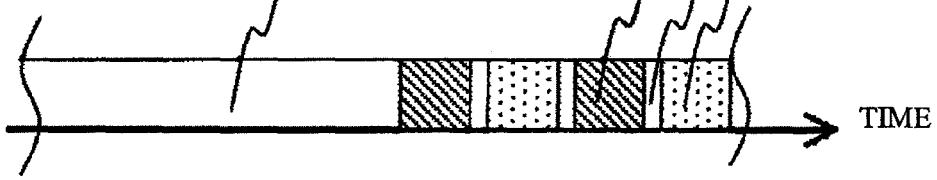
FIG. 7C is a time chart showing an application method of voltage by the actuator for manipulation of liquid droplets.

FIG. 7 is a time chart showing a method of application of voltage for enhancing the conveying capacity of the liquid droplet 15. When the liquid droplet 15 is to be conveyed to the destination position 141, the first axial electrode columns 1313 and 1314 passing through the position of the liquid droplet 15 before conveyance, the first axial electrode columns 1315 and 1316 passing through the destination position 141, and the second axial electrode columns 1333 and 1334 passing through the destination position 141 and the position of the liquid droplet 15 before conveyance are set in any one of the potential $V_1$ state 181, the floating state 182, and the potential $V_2$ state 183, by means of the first axial voltage control device 16 or the second axial voltage control device 17. FIG. 7A represents the state of potential of the first axial electrode columns 1313 and 1314 passing through the position of the liquid droplet 15 before conveyance, FIG. 7B represents the state of potential of the second axial electrode columns 1333 and 1334, and FIG. 7C represents the state of potential of the first axial electrode columns 1315 and 1316 in a time series manner.

Before the conveyance of the liquid droplet 15, for the purpose of stopping the liquid droplet 15, the first axial electrode columns 1313 and 1314 and the second axial electrode columns 1333 and 1334 repeat the period where one electrode columns are set at $V_1$ and the other electrode columns are set at $V_2$. In the period when the potential changes from $V_1$ to $V_2$ (or $V_2$ to $V_2$), both the electrode columns go through a floating state. The repetition may be stopped when the position of the liquid droplet 15 is stabilized. Also, although a deviation between the liquid droplet and the electrode shape may occur, both the electrode columns may be set in a floating state.

Next, when conveying the liquid droplet 15 to the destination position 141, the first axial electrode columns 1313 and 1314 are switched to a floating state, and simultaneously, the first axial electrode columns 1315 and 1316 and the second axial electrode columns 1333 and 1334 are switched so as to repeat the period where the potential of one electrode columns is at $V_1$ and the potential of the other electrode columns is at $V_2$. From the time when the switching is carried out, the conveyance of the liquid droplet 15 to the destination position 141 is started. When the potential is changed from $V_1$ to $V_2$ (or $V_2$ to $V_1$), both the electrode columns go through the floating state. The repetition period of potential of the electrode columns is set from 1 millisecond to 1 second.

When the selected first axial electrode columns and the second axial electrode columns are set in a floating state and the apparent surface wettability returns to its initial state, a restoring force to return the shape of the liquid droplet to its original shape occurs. Also, when it comes to the opposite potential state, an electric charge is induced at the lower surface of the liquid droplet 15, and a repulsive force occurs in both the electrode columns. These two generated forces form a conveying power of the liquid droplet, and the conveying force of the liquid droplet 15 can be enhanced. The first axial voltage control device and the second axial voltage control device may switch the polarity of voltage at a specified interval by applying voltages of mutually opposite phases.

Further, in this voltage application method, when conveying the liquid droplet 15, the position of the liquid droplet can be corrected even if the liquid droplet 15 is slightly deviated from the destination position.

Figure 8:
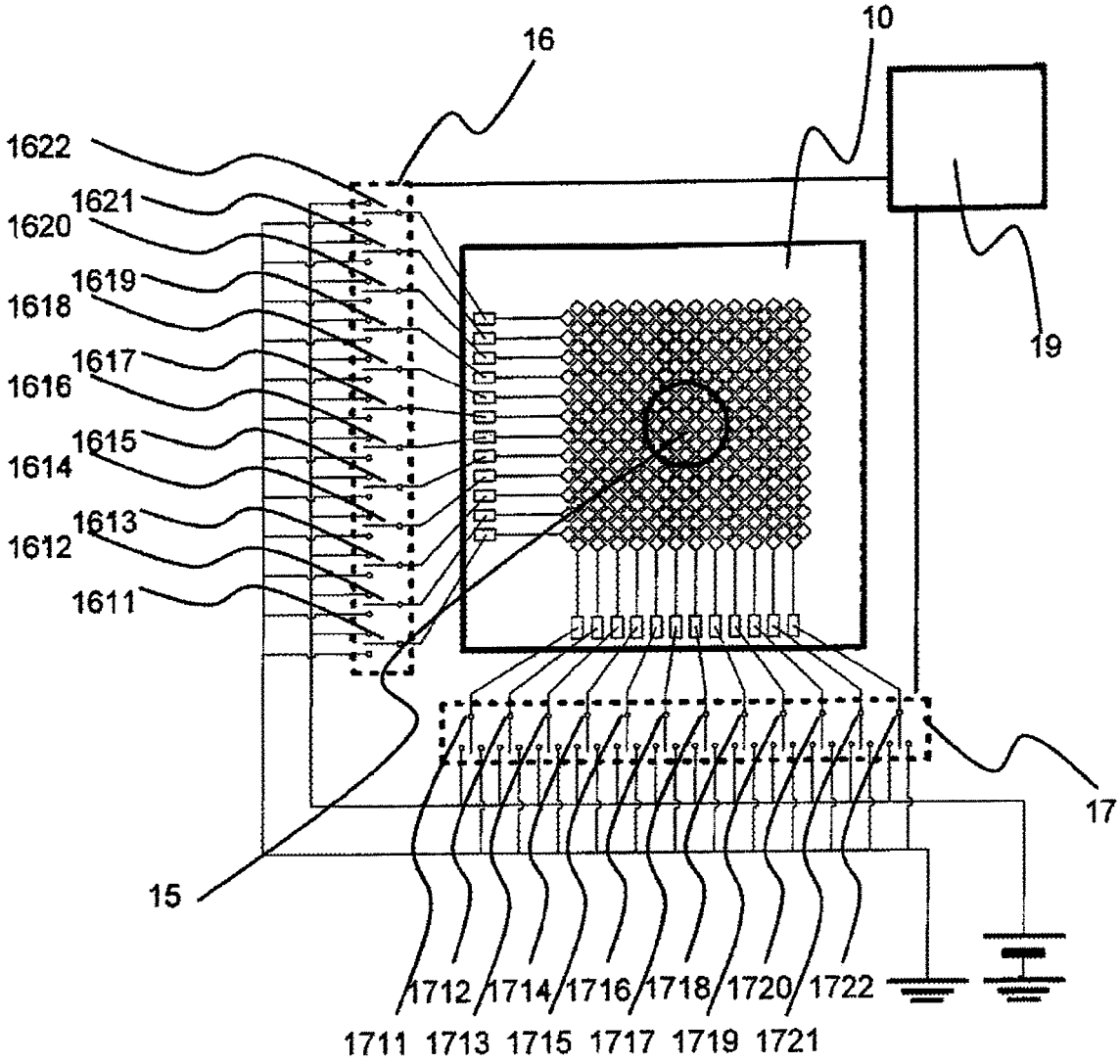
FIG. 8 is an explanatory diagram of the operation when liquid is divided by the actuator for manipulation of liquid droplets.
Figure 9:
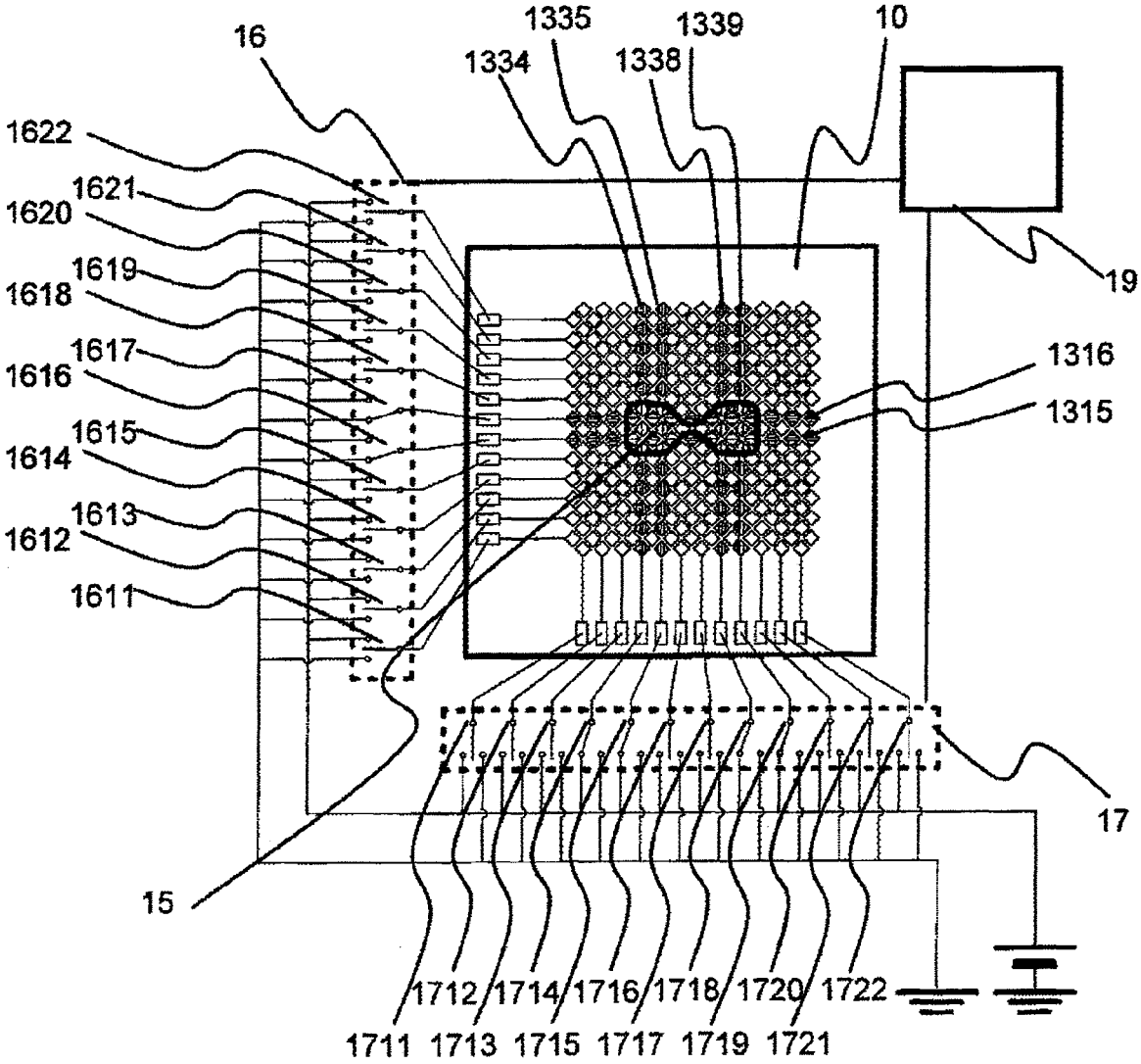
FIG. 9 is an explanatory diagram of the operation when liquid is divided by the actuator for manipulation of liquid droplets.
Figure 10:
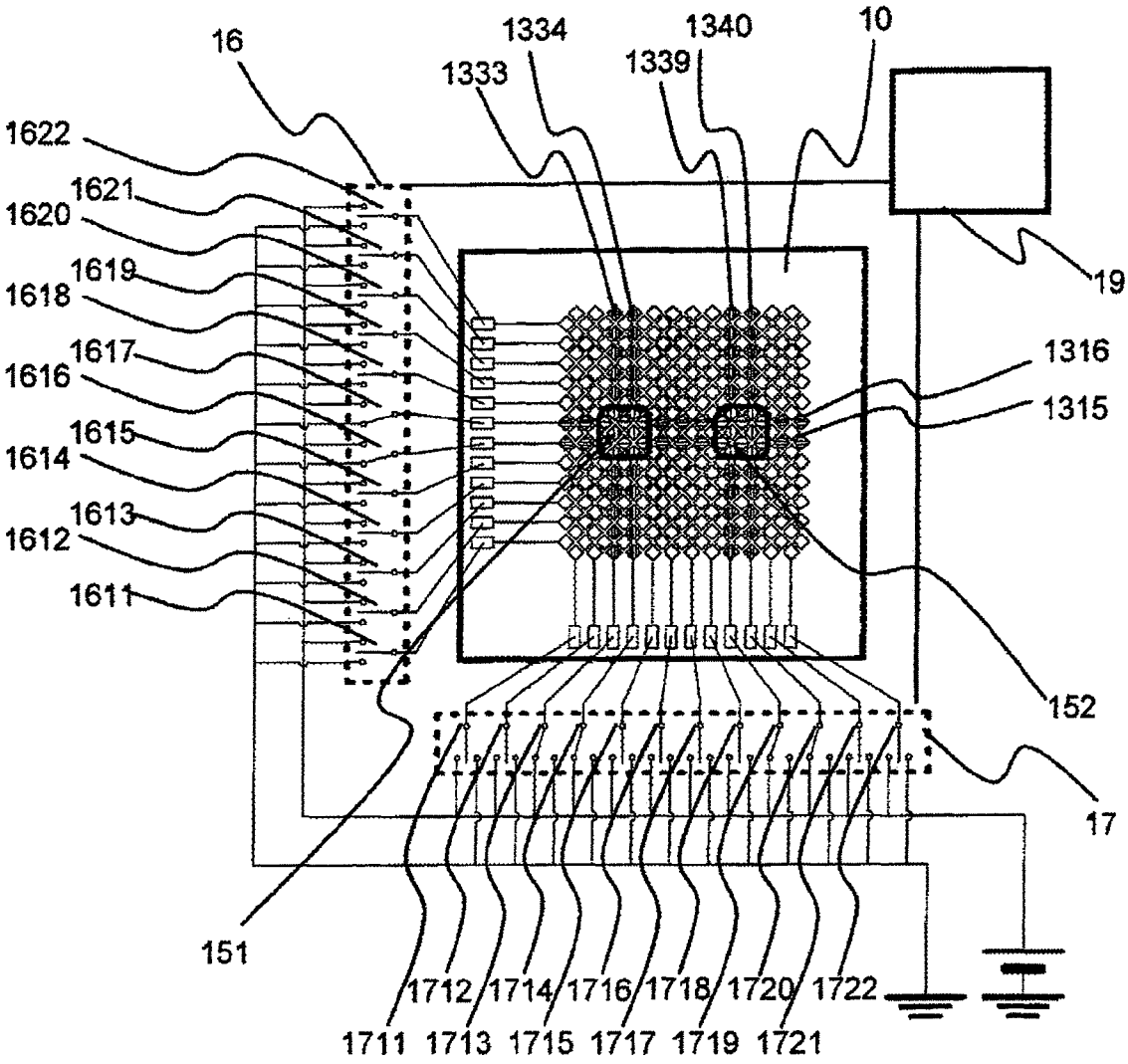
FIG. 10 is an explanatory diagram of the operation when liquid is divided by the actuator for manipulation of liquid droplets.
Figure 11A:
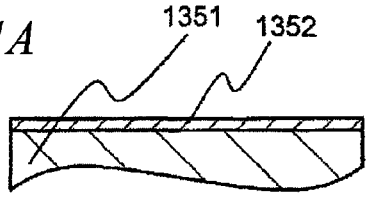
FIG. 11A is an explanatory diagram of manufacturing procedure of a liquid conveying element.
Figure 11B:
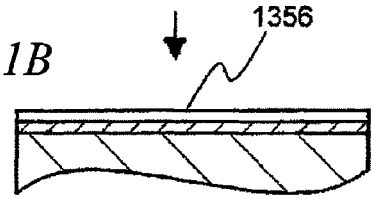
FIG. 11B is an explanatory diagram of manufacturing procedure of a liquid conveying element.
Figure 11C:
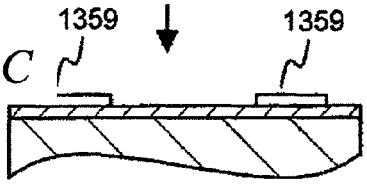
FIG. 11C is an explanatory diagram of manufacturing procedure of a liquid conveying element.
Figure 11D:
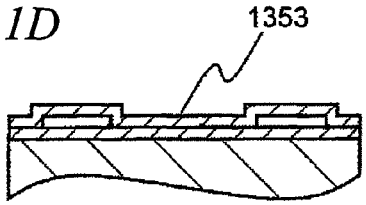
FIG. 11D is an explanatory diagram of manufacturing procedure of a liquid conveying element.
Figure 11E:
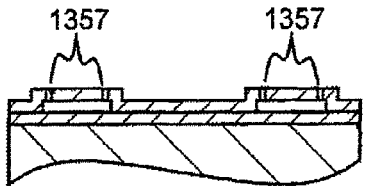
FIG. 11E is an explanatory diagram of manufacturing procedure of a liquid conveying element.
Figure 11F:
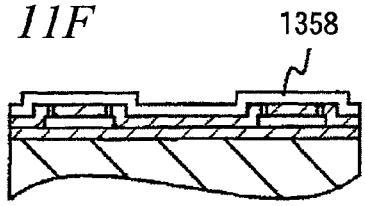
FIG. 11F is an explanatory diagram of manufacturing procedure of a liquid conveying element.
Figure 11G:
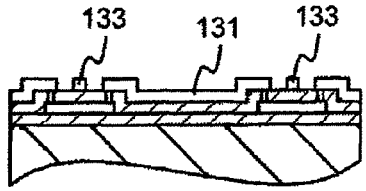
FIG. 11G is an explanatory diagram of manufacturing procedure of a liquid conveying element.
Figure 11H:
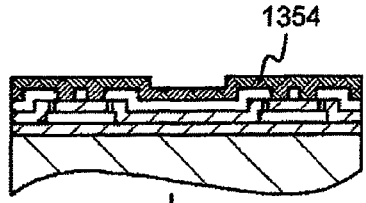
FIG. 11H is an explanatory diagram of manufacturing procedure of a liquid conveying element.
Figure 11I:
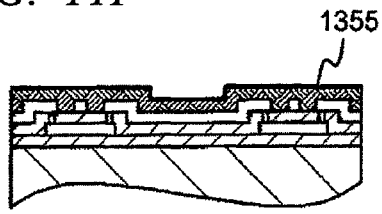
FIG. 11I is an explanatory diagram of manufacturing procedure of a liquid conveying element.

FIG. 8 to FIG. 10 are explanatory diagrams for describing the operation of the actuator for manipulation of liquid droplets 1 when the liquid droplet 15 is divided into two droplets. The diagrams show the state of the first axial liquid conveying switches 1611 to 1622 and the second axial liquid conveying switches 1711 to 1722 and the movement of the liquid droplet 15 in each operation.

The process of dividing the liquid droplet 15 into two droplets 151 and 152 will be described with reference to FIG. 8 to FIG. 10. The operation of first axial liquid conveying switches 1611 to 1622 and the second axial liquid conveying switches 1711 to 1722 is controlled by the first axial voltage control device 16 and the second axial voltage control device 17 according to the signal outputted from the system device 19.

FIG. 8 shows a state before the division of the liquid droplet 15. In this state, the first axial liquid conveying switches 1611 to 1622 and the second axial liquid conveying switches 1711 to 1722 are controlled so that all of the corresponding first axial electrode columns 1311 to 1322 and second axial electrode columns 1331 to 1342 are set in a floating state. Also in this state, instead of the floating state, the potentials $V_1$ and $V_2$ may be applied to the selected first axial electrode columns and second axial electrode columns so as to apply a potential difference to the region in which the liquid droplet is present.

FIG. 9 shows the shape of the liquid droplet 15 in the middle of the process of dividing the liquid droplet 15 and the state of the first axial liquid conveying switches 1611 to 1622 and the second axial liquid conveying switches 1711 to 1722. At this time, the first axial liquid conveying switches 1616 and 1617 and the second axial liquid conveying switches 1714, 1715, 1718, and 1719 are changed over so that the first axial electrode columns 1315 and 1316 are set in a state of $V_1$ (or $V_2$) and the second axial electrode columns 1334, 1335, 1338, and 1339 are set in a state of $V_2$ (or $V_1$). More specifically, a potential is applied to one column group including at least one electrode column in the first axial direction, and a potential is applied to at least two column groups including at least one electrode column each in the second axial direction. In this case, if the column group includes a plurality of electrode columns, the electrode columns are supposed to be composed of mutually adjacent electrode columns. From the surface of the region where the first axial electrode columns 1315 and 1316 at the potential $V_1$ and the second axial electrode columns 1334 and 1335 at the potential $V_2$ are adjacent to each other and the surface of the region where the first axial electrode columns 1315 and 1316 at the potential $V_1$ and the second axial electrode columns 1338 and 1339 at the potential $V_2$ are adjacent to each other, the liquid droplet 15 receives driving forces in opposite directions and is then separated.

Next, FIG. 10 shows the state of the first axial liquid conveying switches 1611 to 1622 and the second axial liquid conveying switches 1711 to 1722 when the liquid droplet 15 is divided into two droplets 151 and 152. At this time, the first axial liquid conveying switches 1616 and 1617 and the second axial liquid conveying switches 1713, 1714, 1719, and 1720 are changed over so that the first axial electrode columns 1335 and 1336 are set in a state of potential $V_1$ (or $V_2$) and the second axial electrode columns 1313, 1314, 1319, and 1320 are set in a state of potential $V_2$ (or $V_1$). More specifically, while keeping the position of one column group including at least one electrode column in the first axial direction to which the potential is applied, the positions of at least two column groups including at least one electrode column in the second axial direction to which the potential is applied are changed in opposite directions away from each other. From the surface of the region where the first axial electrode columns 1315 and 1316 at the potential $V_1$ and the second axial electrode columns 1333 and 1334 at the potential $V_2$ are adjacent to each other and the surface of the region where the first axial electrode columns 1315 and 1316 at the potential $V_1$ and the second axial electrode columns 1339 and 1340 at the potential $V_2$ are adjacent to each other, the liquid droplet 15 receives driving forces in opposite directions. By further separating them, the liquid droplet 15 can be held in a separated state into the droplet 151 and the droplet 152.

Meanwhile, through the procedure reverse to that described above, two droplets can be combined into one droplet by applying driving forces to the two droplets 151 and 152 in approaching directions.

FIG. 11 is a process sectional view showing a manufacturing method of the liquid conveying substrate 13. FIG. 11A to FIG. 11I are sectional views taken along the line A-A' in FIG. 4.

(A) A thermal oxidation process is performed to the base substrate (silicon) 1351 to form a silicon oxide film layer of 300 nm in thickness to be the bottom insulating layer 1352 on the surface thereof.

(B) As a conductor layer 1356 for forming the lower layer conductor 1359 which is a part of the first axial coupling conductor 132, a titanium nitride/tungsten layer is deposited to have a thickness of 20 nm/150 nm by chemical vapor deposition method.

(C) After a pattern is formed by photolithography, the conductor layer 1356 is etched to form the lower layer conductors 1359.

(D) A silicon oxide film layer is deposited as the insulating layer between electrode columns 1353.

(E) Photolithography and etching are performed to form through holes for plugs 1357. Subsequently, a titanium nitride/tungsten layer is deposited by chemical vapor deposition method, and etching back is performed to form the plugs 1357.

(F) As the conductor layer 1358 for the rectangular electrode 131 and the second axial coupling conductor 135, a titanium nitride/tungsten layer is deposited to have a thickness of 20 nm/150 nm by chemical vapor deposition method.

(G) After a pattern is formed by photolithography, the conductor layer 1358 is etched to form a rectangular electrode 131 and second axial coupling conductors 133.

(H) As the dielectric layer 1354, silicon nitride is deposited to have a thickness of 75 nm by chemical vapor deposition method. For connecting the wiring positions of external power source and rectangular electrode 131, a pattern is formed by photolithography, and then the dielectric layer 1354 covering the wiring positions is removed by etching.

(I) Fluorine-based resin to be used as the water repellent layer 1355 is spin-coated.

In this method, the etching back is performed to embed the metal film, thereby forming the plugs 1357. However, it is also possible to form the plugs 1357 simultaneously with the rectangular electrode 131 and the second axial coupling conductors 133 by omitting this process.

Figure 12:
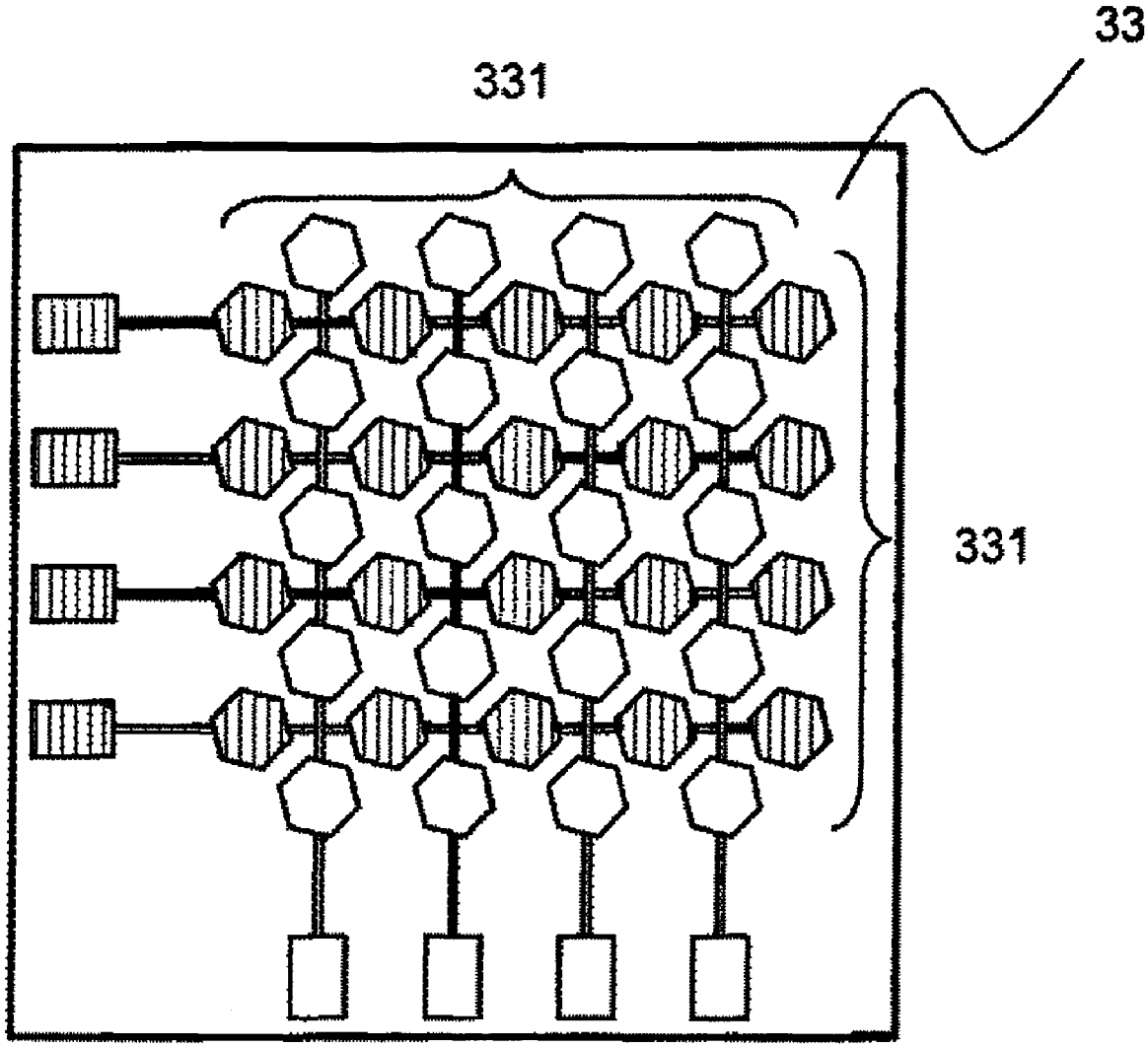
FIG. 12 is a plan view of a liquid conveying substrate where regular hexagonal electrodes are coupled.
Figure 13:
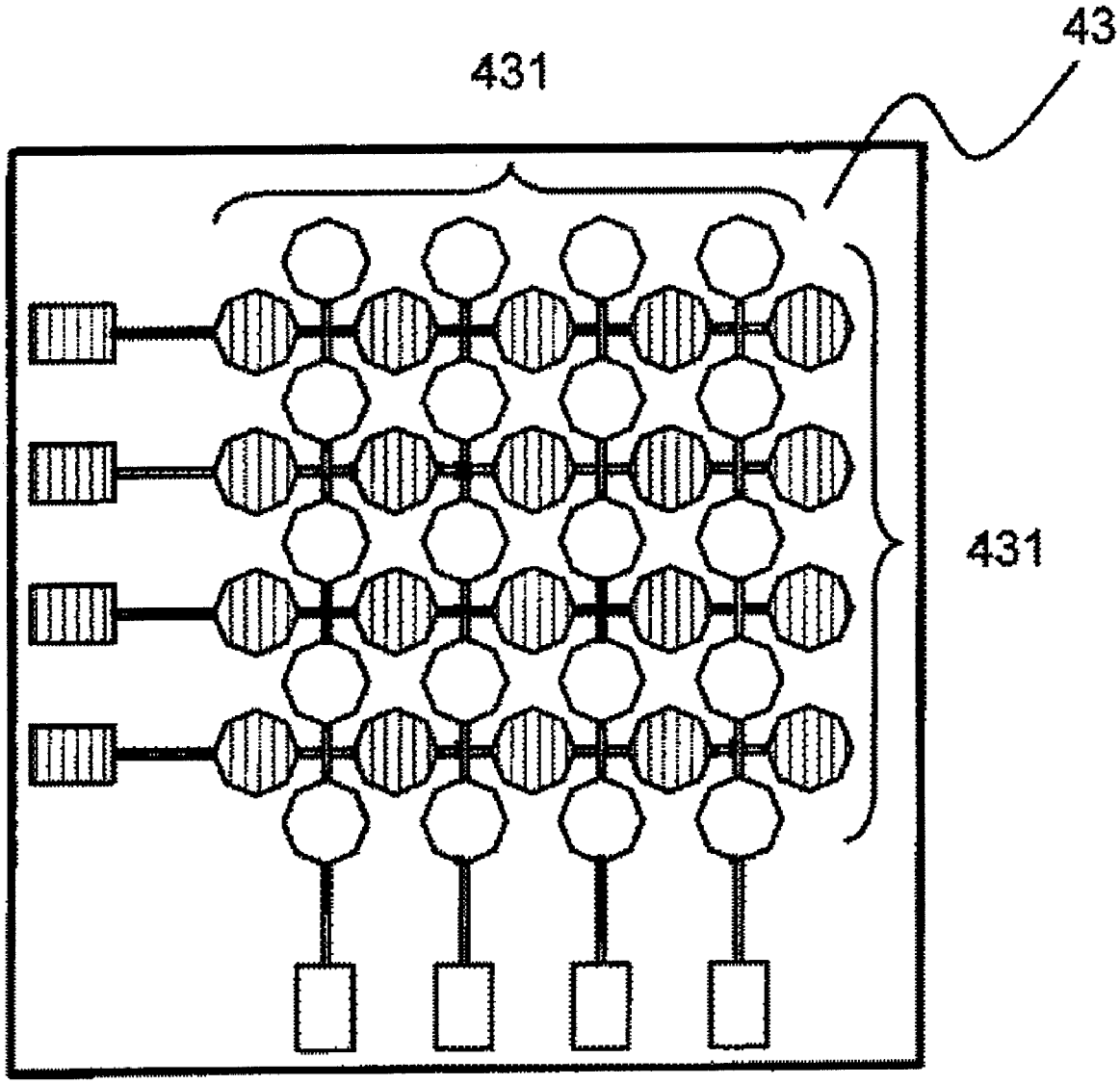
FIG. 13 is a plan view of a liquid conveying substrate where regular octagonal electrodes are coupled.

FIG. 12 is a model diagram of a liquid conveying substrate 33 in which the rectangular electrodes 131 of the liquid conveying substrate 13 are replaced by regular hexagonal electrodes 331, and FIG. 13 is a model diagram of a liquid conveying substrate 43 in which the rectangular electrodes 131 of the liquid conveying substrate 13 are replaced by regular octagonal electrodes 431. In the liquid conveying substrate 13 where the rectangular electrodes 131 are coupled in a diagonal direction, one rectangular electrode constituting the second axial electrode column is disposed at a position inside a lattice whose vertices are centers of gravity of four adjacent rectangular electrodes in the two consecutive first axial electrode columns.

The electrodes coupled in the x-axis direction in the diagram are hatched so as to be distinguished. They are disposed so that the positions of the centers of gravity of the electrodes coincide with the positions of the centers of gravity of the rectangular electrodes 131 of the liquid conveying substrate 13 in FIG. 3.

Figure 14:
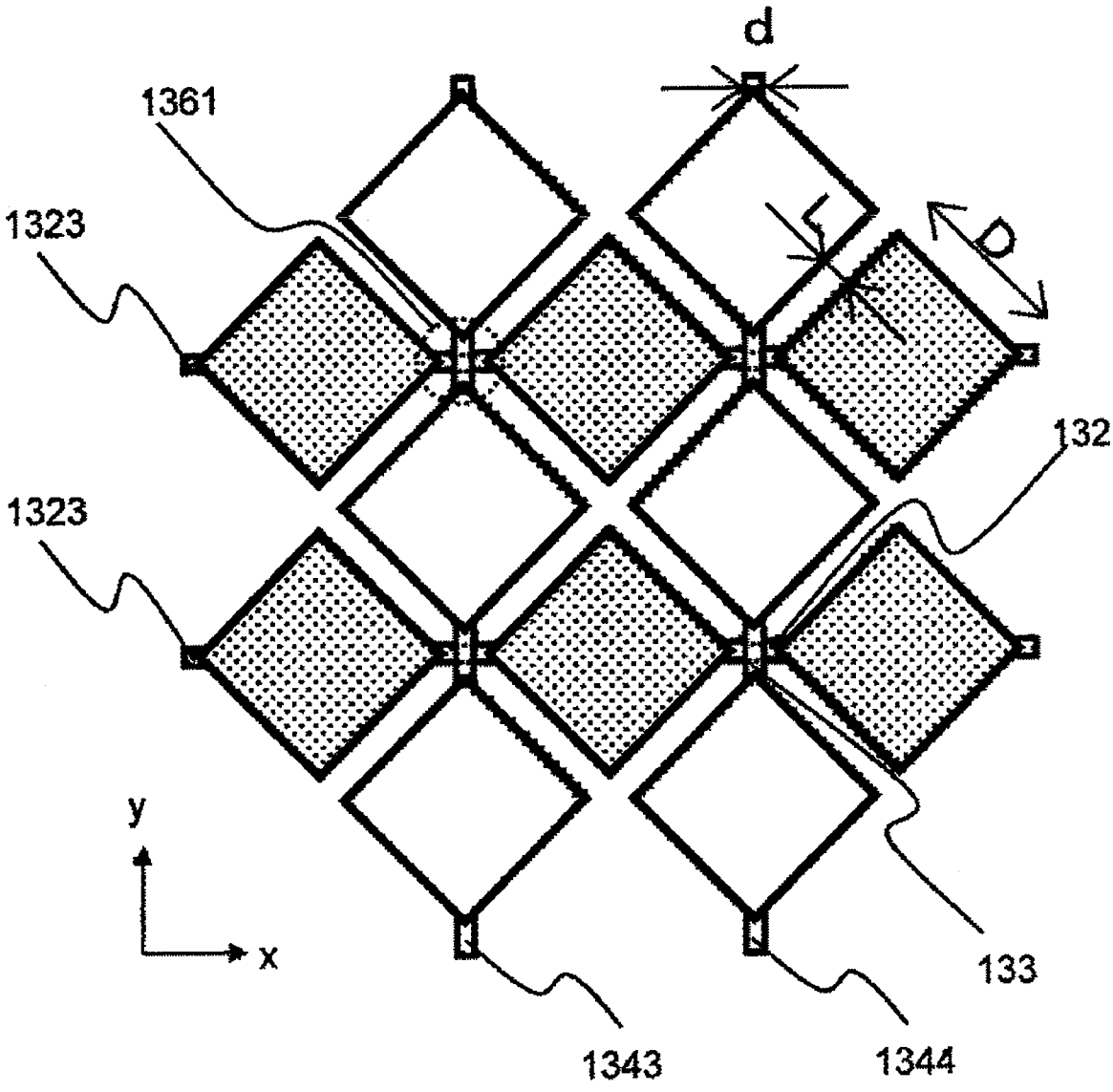
FIG. 14 is a model diagram of a liquid conveying substrate.

FIG. 14 is a model diagram of a part of the liquid conveying substrate 13, in which a length D of one side of the rectangular electrode 131 is estimated from a width d of the first axial coupling conductor 132 and the second axial coupling conductor 133 (provided D>d).

All conductors for connecting the rectangular electrodes 131 in an x direction in the diagram are referred to as first axial coupling conductors 132, and all conductors for connecting them in a y direction in the diagram are referred to as second axial coupling conductors 133. The rectangular electrodes 131 connected in an x direction by the first axial coupling conductors 132 are regarded as one electrode column in each row, and they are called first axial electrode columns 1323 to 1324. Also, the rectangular electrodes 131 connected in a y direction by the second axial coupling conductors 133 are regarded as one electrode column in each column, and they are called second axial electrode columns 1343 to 1344. In the diagram, the rectangular electrodes 131 constituting the first axial electrode columns 1323 to 1324 and the first axial coupling conductors 132 are hatched. Also, in the crossing region 1361 of the first axial coupling conductor 132 and the second axial coupling conductor 133, the coupling conductor positioned in the lower layer is drawn by dotted lines.

In the crossing region 1361 of the first axial coupling conductor 132 and the second axial coupling conductor 133, a dielectric layer between electrodes 1353 (FIG. 5) is interposed between two coupling electrodes, and the two coupling conductors form an electric capacity (hereinafter, referred to as electric capacity between wirings). Supposing that the insulating layer between electrodes 1353 (FIG. 5) has dielectric constant of $\in$ and thickness of h, the electric capacity per one crossing region of the first axial coupling conductor 132 and the second axial coupling conductor 133 is $\in d^2/h$.

Also, when the liquid droplet 15 is in contact with the rectangular electrode 131 via the dielectric layer 1354, an electric capacity between rectangular electrodes 131 via the liquid droplet (hereinafter, referred to as electric capacity between electrodes) is formed.

The larger the electric capacity between electrodes and the smaller the electric capacity between wirings, the liquid droplet can be conveyed at the lower potential difference. Supposing that the ratio of the electric capacity between wirings and the electric capacity between electrodes is larger than 1:100 and $\in \approx \in'$, $h \approx H$, and d>100 nm are satisfied, D>1 μm can be obtained. Also, supposing that the number of electrode columns is N, the total area S of the rectangular electrode group is about $2N^2D^2$. Therefore, if N<1000 and S<100×100 $cm^2$ are satisfied, D<1 mm can be obtained. Further, the range of the area $D^2$ of the rectangular electrode 131 is 1 $\mu m^2 < D^2 < 1$ $mm^2$. Also in the case of electrodes with different shape other than the rectangular electrode such as the hexagonal electrode 331 shown in FIG. 12, it is preferable to design the electrode to have an area within the same range.

Figure 15:
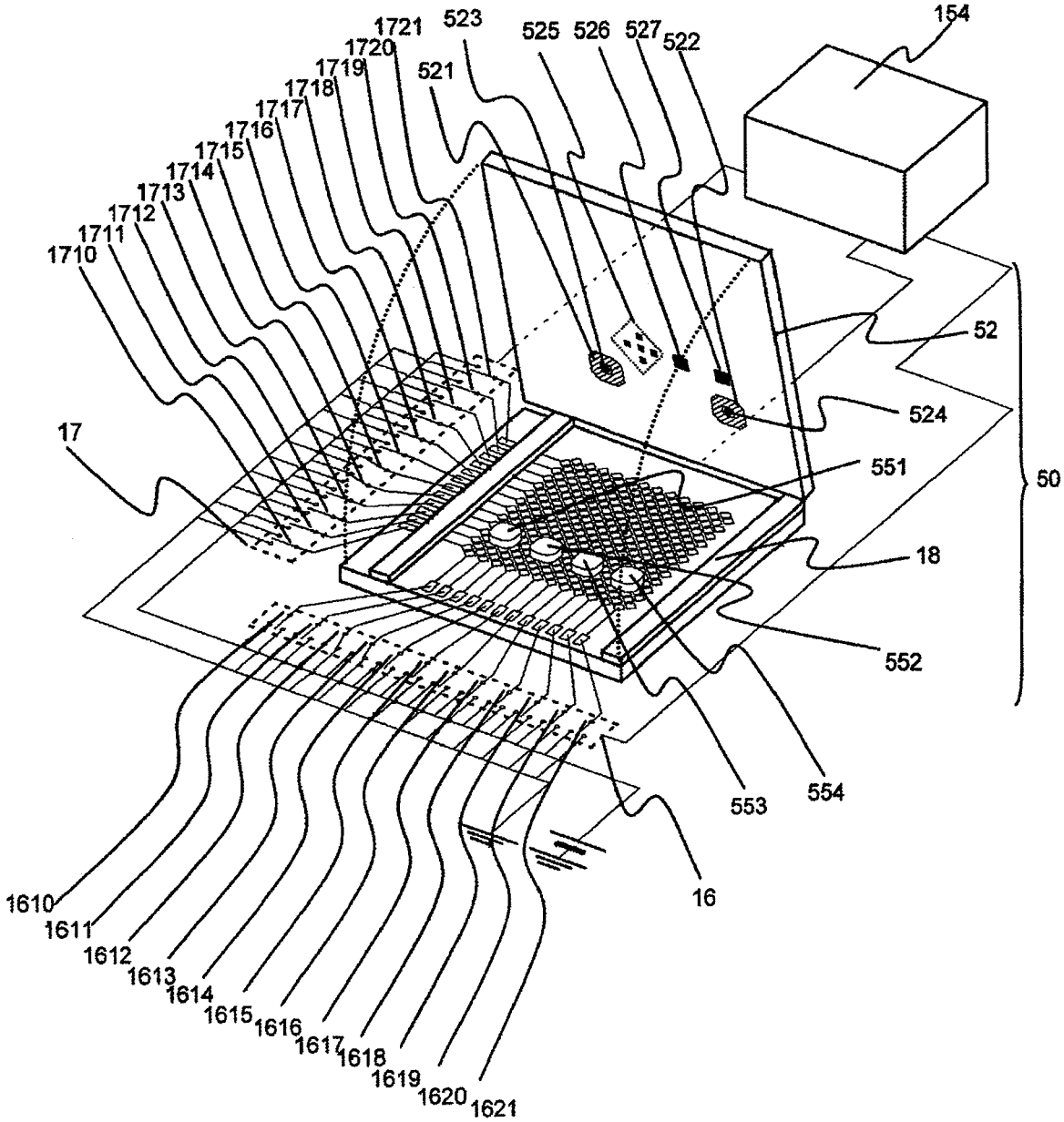
FIG. 15 is a diagram showing an example of a structure of chemical analysis apparatus.

FIG. 15 is a block diagram of a chemical reaction analysis apparatus 5 using a chemical reaction analysis element 50 in which the liquid conveying substrate 13 and a sensor-reactor substrate 52 are combined. In FIG. 15, the chemical reaction analysis element 50 is shown in a development view, but when in use, the liquid conveying substrate 13 and the chemical reaction analysis element 50 are disposed so as to form a gap therebetween by means of a spacer 18. It is preferable that the liquid conveying substrate 13 and the chemical reaction analysis element 50 are disposed substantially in parallel. The chemical reaction analysis apparatus 5 comprises the first axial voltage control device 16 and the second axial voltage control device 17 for controlling the voltage to be applied to the liquid conveying substrate 13 and a system device 59 for outputting a control signal to the first axial voltage control device 16 and second axial voltage control device 17 and analyzing the signal outputted from the sensor-reactor substrate.

The chemical reaction analysis element 50 is configured by arranging the liquid conveying substrate 13 and the sensor-reactor substrate 52 in parallel so as to form a gap by means of the spacer 18 therebetween, and the droplets 251 to 254 to be conveyed are held in the gap.

The sensor-reactor substrate 52 comprises temperature regulators 521 and 522 for regulating the temperature of the droplets 551 to 554, thermometers 523 and 524 disposed at the center of the temperature regulators 521 and 522 for measuring the temperature of the droplets, a sensor 525 for detecting specific molecules and ions in the droplets, and a reactor 526 having a catalyst for promoting chemical reaction of specific molecules and ions in the droplets.

According to the signal outputted from the system device 59, the first axial voltage control device 16 and the second axial voltage control device 17 change over the first axial liquid conveying switches 1610 to 1621 and the second axial liquid conveying switches 1710 to 1721 to control the electric state of the rectangular electrodes 131 to one of the ground, potential given from power source, and floating, thereby conveying the liquid droplets 551 to 554. In addition to the control of the conveyance of liquid drops, the system device 59 also performs the control of the temperature regulators 521 and 522 and processing of the signals outputted from the thermometers 523 and 524 and the sensor 525.

Figure 16:
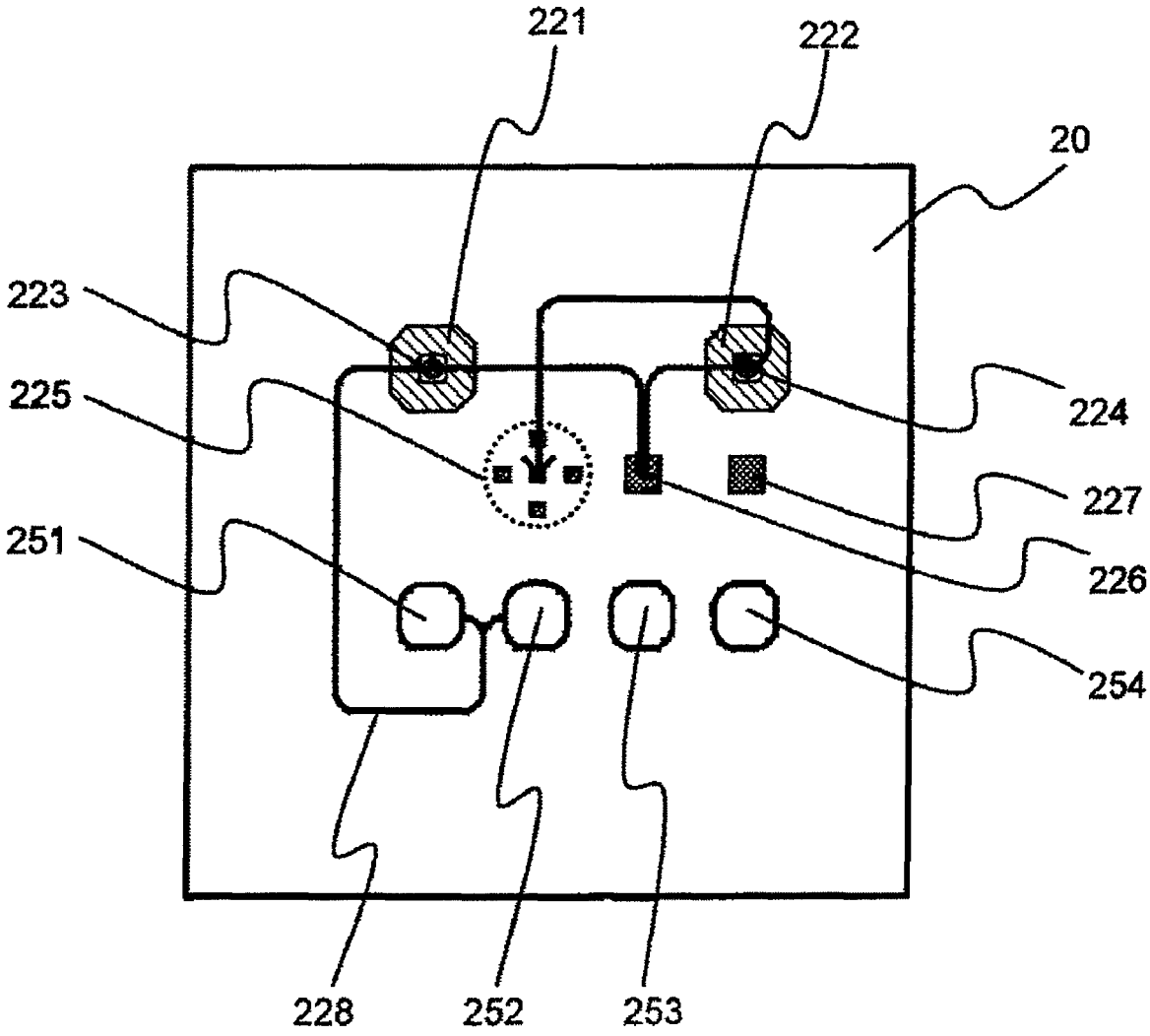
FIG. 16 is a diagram showing an example of use of the chemical analysis apparatus.

FIG. 16 is a diagram of a conveying route of the droplets 251 to 254, showing an example of chemical analysis by the chemical reaction analysis element 20.

The droplets 251 to 252 are conveyed along a route 228. On the route 228, the droplets 251 to 252 are combined in one droplet and then conveyed to the temperature regulator 221 to be heated or cooled. The temperature of the droplet at this time is monitored by the temperature sensor 223 (temperature regulating step). Next, the droplet is conveyed to the reactor 226, and the chemical substance or biological substance in the reactor is reacted with the substance in the liquid droplet (chemical reaction step). Then, the liquid droplet is conveyed to the temperature regulator 222 to be heated or cooled. The temperature of the droplet at this time is monitored by the temperature sensor 224 (temperature regulating step). Finally, the droplet is conveyed to the sensor 225, and the amount of chemical substance or biological substance contained in the droplet is monitored (analysis step).

The conveying route of the droplets 251 to 254 can be freely selected within a two-dimensional plane. By changing the conveying route in accordance with the purpose, processes such as the basic operation of mixing and dividing of liquid droplets, the temperature regulating step by the temperature regulators 221 and 222 and the temperature sensors 223 and 224, the chemical reaction step by the reactors 226 and 227, and the analysis step by the sensor 225 can be combined freely in accordance with the purpose of the user. Moreover, by changing the conveying route of liquid, the order of the detection by sensor, the temperature detection by temperature regulator, and the reaction by reactor can be controlled.

What is claimed is:

1. A liquid conveying substrate, comprising:

a substrate;

a plurality of first electrodes disposed on the substrate and arranged in a plurality of columns in a first axial direction;

a plurality of first conductors respectively connecting two adjacent first electrodes of the plurality of first electrodes and arranged along the first axial direction;

a plurality of second electrodes disposed on the substrate and arranged in a plurality of columns in a second axial direction crossing with the first axial direction;

a plurality of second conductors respectively connecting two adjacent second electrodes of the plurality of second electrodes, arranged along the second axial direction, and crossing with the first conductors; and an insulating layer for insulating the first conductors and the second conductors, wherein the first conductor and the second conductor cross with each other in a region where the first electrodes and the second electrodes are not positioned as seen from a side where the first electrodes are substantially disposed, and the insulating layer is positioned at least in the crossing region.

2. The liquid conveying substrate according to claim 1, wherein the second electrode is disposed within a lattice formed of centers of gravity of four adjacent first electrodes in two consecutive columns in the first axial direction.

3. The liquid conveying substrate according to claim 1, further comprising:

a dielectric layer disposed on the first electrodes and the second electrodes, and the first conductors and the second conductors as seen from the substrate, wherein the dielectric layer has a water repellent surface.

4. The liquid conveying substrate according to claim 1, wherein the first electrodes and the second electrodes are polygonal.

5. The liquid conveying substrate according to claim 1, wherein the first electrodes and the second electrodes are even-numbered polygonal.

6. The liquid conveying substrate according to claim 1, wherein the first electrodes and the second electrodes are square, a first vertex and a second vertex opposite to the first vertex are disposed in the first axial direction, and a third vertex and a fourth vertex opposite to the third vertex are disposed in the second axial direction.

7. The liquid conveying substrate according to claim 1, further comprising:

first voltage control means for controlling the voltage applied to the plurality of first electrodes; and second voltage control means for controlling the voltage applied to the plurality of second electrodes, wherein the first voltage control means and the second voltage control means control the number of columns for applying voltages.

8. The liquid conveying substrate according to claim 7, wherein the first voltage control means applies a potential to one column group including at least one column in the first axial direction, and the second voltage control means applies a voltage to at least two column groups including at least one column in the second axial direction.

9. The liquid conveying substrate according to claim 1, wherein an area of the first electrode or the second electrode is 1 $\mu m^2$ or more to 1 $mm^2$ or less.

10. The liquid conveying substrate according to claim 1, wherein a flat substrate is disposed in parallel to the liquid conveying substrate at an interval of 100 nm or more to 1 mm or less to form a liquid conveying element.

11. An actuator for manipulation of liquid droplets, comprising:

a substrate;

a plurality of first electrodes disposed on the substrate and arranged in a plurality of columns in a first axial direction;

a plurality of first conductors respectively connecting two adjacent first electrodes of the plurality of first electrodes and arranged along the first axial direction;

a plurality of second electrodes disposed on the substrate and arranged in a plurality of columns in a second axial direction crossing with the first axial direction;

a plurality of second conductors respectively connecting two adjacent second electrodes of the plurality of second electrodes, arranged along the second axial direction, and crossing with the first conductors;

an insulating layer for insulating the first conductors and the second conductors;

first voltage application control means for controlling a voltage applied to the first electrodes; and second voltage application control means for controlling a voltage applied to the second electrodes, wherein the first conductor and the second conductor cross with each other in a region where the first electrodes and the second electrodes are not positioned as seen from a side where the first electrodes are substantially disposed, the insulating layer is positioned at least in the crossing region, and the first voltage application control means and the second voltage application control means apply a potential difference between the first electrodes and the second electrodes.

12. The actuator for manipulation of liquid droplets according to claim 11, wherein the first voltage application control means and the second voltage application control means apply voltages of opposite phases, and polarity of the voltages is changed at a specified interval.

13. The actuator for manipulation of liquid droplets according to claim 11, further comprising:

at least one of a sensor, a temperature regulator, and a reactor.

14. A chemical reaction analysis method using the actuator for manipulation of liquid droplets according to claim 13, wherein an order of detection by a sensor, temperature detection by a temperature regulator, and reaction by a reactor is changed by controlling a liquid conveying route.

* * * * *